United States Patent [19]

Biloff

[11] 4,056,870

[45] Nov. 8, 1977

[54] HAND HELD POWERED METAL CLINCHING TOOL

[76] Inventor: Elmer E. Biloff, 18289 Thomas Lane, Shafter, Calif. 93263

[21] Appl. No.: 710,547

[22] Filed: Aug. 2, 1976

[51] Int. Cl.[2] ..... B23P 11/00; B23P 19/00; B25B 25/00; B25B 27/00

[52] U.S. Cl. ..... 29/21.1

[58] Field of Search ..... 29/21.1; 72/325, 326, 72/327, 332, 333, 335; 93/1.1

[56] References Cited

U.S. PATENT DOCUMENTS

| | | | |
|---|---|---|---|
| 731,624 | 6/1903 | Ruth | 29/21.1 |
| 2,964,829 | 12/1960 | Spengler et al. | 29/21.1 |
| 3,261,073 | 7/1966 | Klenk | 29/21.1 |
| 3,541,685 | 11/1970 | Gizdich | 72/326 |

*Primary Examiner*—Othell M. Simpson
*Assistant Examiner*—Horace M. Culver
*Attorney, Agent, or Firm*—Dennis B. Haase

[57] ABSTRACT

The present invention pertains to a power integrated sequential timing and drive mechanism for operating the forming unit of a hand held powered metal clinching tool through a cycle beginning with a normally open position and passing through a clinching position and return. The drive mechanism, which is interposed between a forming unit and a suitable power source such as a reciprocating pneumatic motor comprises a driving arm which is pivotally mounted to effect a multiplication of the force generated by the motor on a punch which comprises a portion of the forming unit. A slave arm is disposed opposite the driving arm and is operable in conjunction therewith by means of an interconnected collapsible link disposed between the two. The assembly is so constructed that upon operation of the motor on a clinching stroke, the collapsible link is moved to a lock position causing coincident but time sequenced movement of the punch and die of the forming unit whereby the punch is initially driven through the metal flanges to be clinched. Upon initial return, the die follows to engage the flanges, causing metal tabs formed by the punching movement to be folded back to effect the clinching action. As the return stroke continues, the collapsible link is urged into contact with a cam causing it to collapse and the forming unit to be opened to permit freeing of the clinched flanges thereby setting the unit for its next cycle.

7 Claims, 6 Drawing Figures

Fig. 1
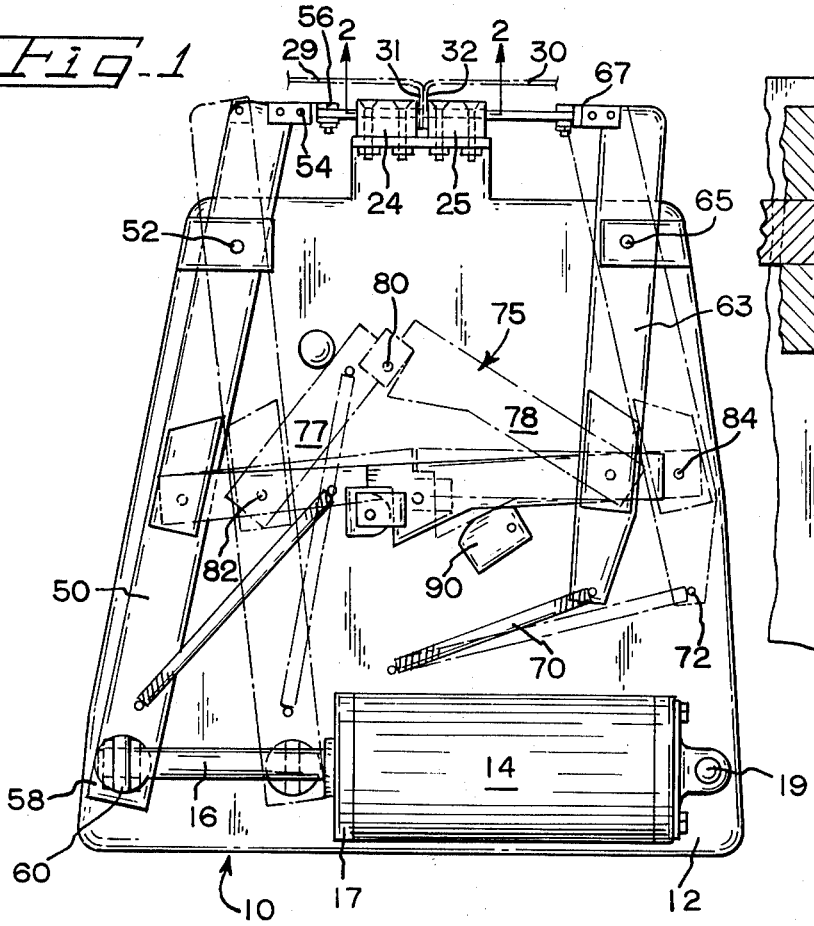
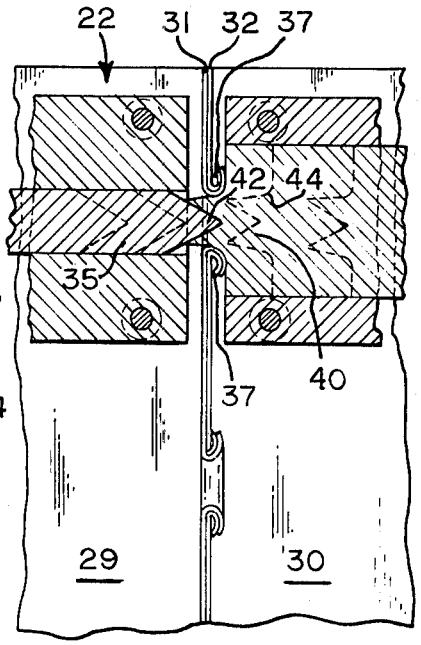
Fig. 2
Fig. 3
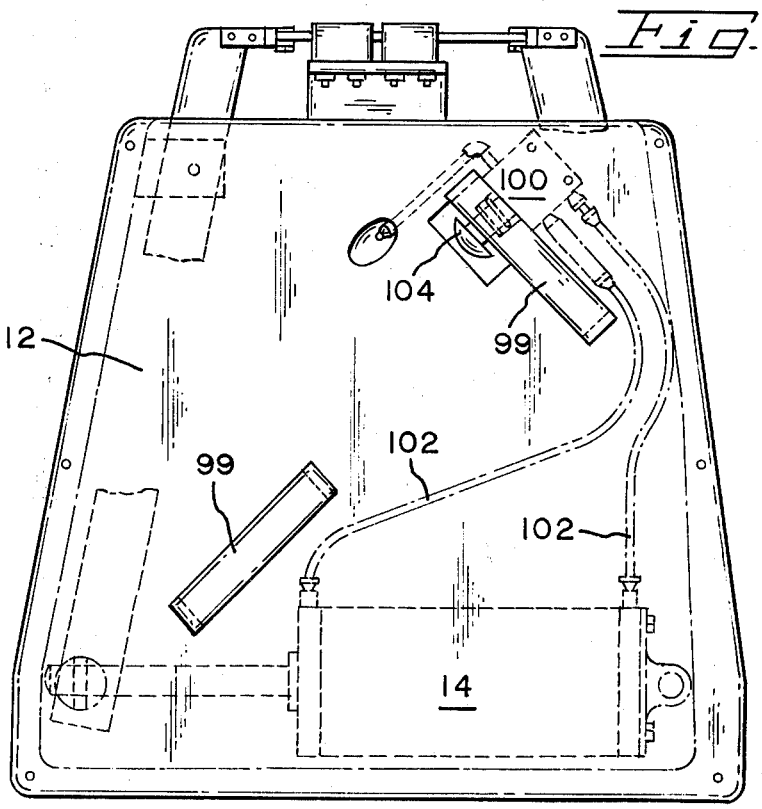

Fig. 4
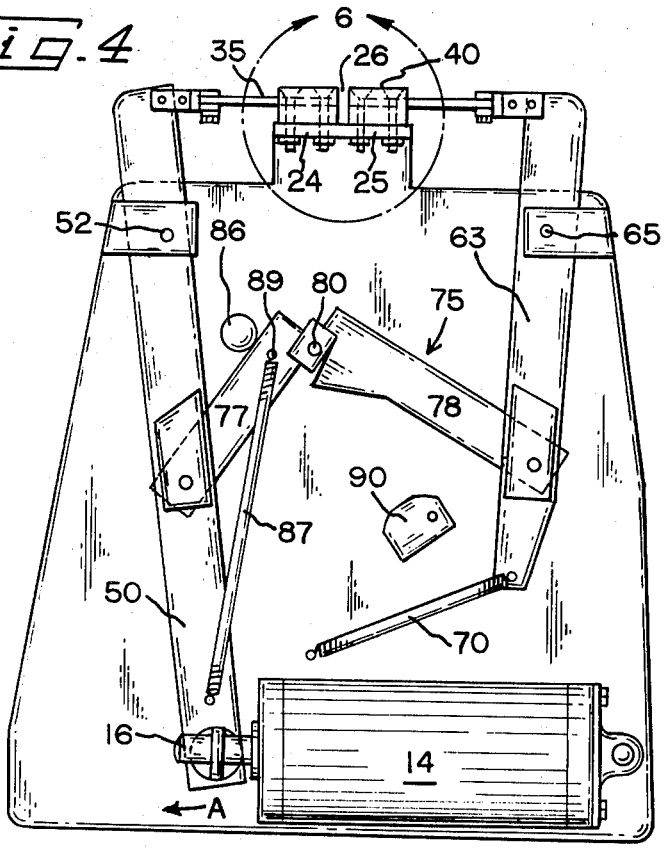
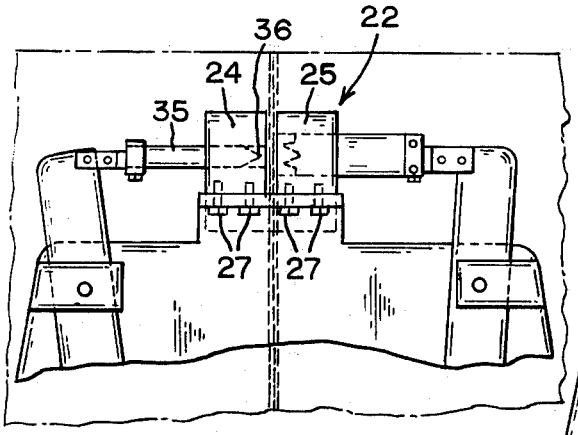
Fig. 6
Fig. 5
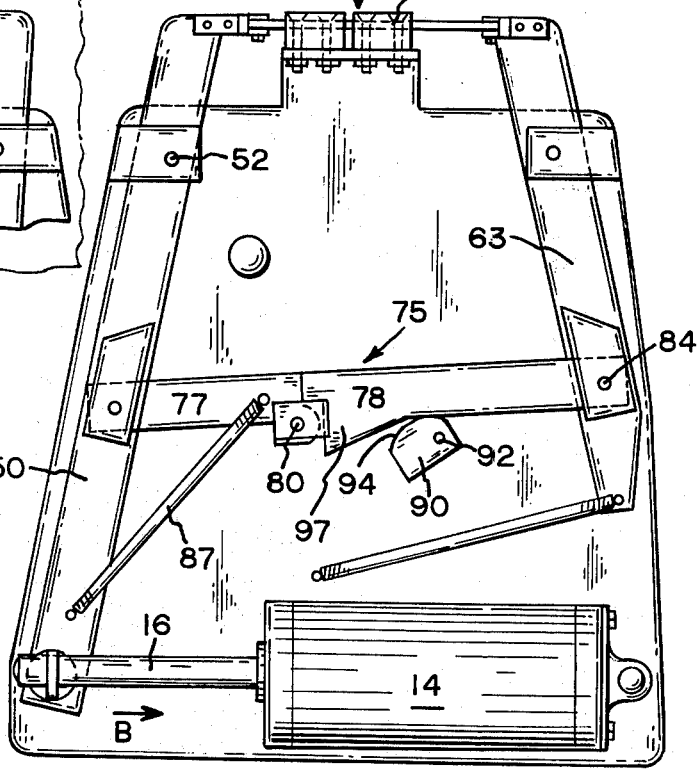

HAND HELD POWERED METAL CLINCHING TOOL

BACKGROUND OF THE INVENTION

1. Field of the Invention

The present invention relates to improvements in metal clinching devices, having as their purpose the fastening of two contiguous sheets of metal by piercing and tearing the metal flanges so as to form tabs which are then folded back against the flanges to secure the flanges together.

2. Description of the Prior Art

Clinching mechanisms of the general type to which the present invention pertains have been under a constant state of development as far back as 1932 and even though spot welding and pop rivet techniques are in current wide use, there is a continuing need for a fast, efficient and inexpensive means of fastening contiguous sheet metal members together along a flange of seam particularly in products where space limitations may make other means impractical. Among those who have attempted to devise tools of the type to which the present invention pertains include R. H. Spingler, et al., U.S. Pat. No. 2,964,829 and somewhat later effort by K. J. Klenk, U.S. Pat. No. 3,261,073. While all of these patent efforts have a comparable purpose, each provides a different, and more cumbersome, approach to the problem and each, for many reasons, fails to provide the handling and efficiency of the present device.

BRIEF DESCRIPTION OF THE DRAWING

The drawings, comprising two sheets and six figures, depict the invention as follows:

FIG. 1 is a front elevation of a preferred embodiment of the tool of the present invention illustrating particularly the integrated sequential timing and drive mechanisms at the top of the cycle in its normally open configuration, shown in broken lines and its closed or clinching configuration in solid lines;

FIG. 2 is a partial sectional view taken along lines 2—2 of FIG. 1 and illustrating the interrelationship between the punch and die;

FIG. 3 is a rear elevation of the tool of FIG. 1 illustrating the pneumatic motor and operating mechanism;

FIG. 4 is a front elevation similar to that shown in FIG. 1 with the device in its normally open configuration;

FIG. 5 is a view similar to FIG. 1 showing the device in its clinching configuration; and FIG. 6 is a view of the forming unit shown in the areas surrounded by the intersecting circle 6 of FIG. 4 and illustrating the punch and die in their normally open position.

DESCRIPTION OF THE PREFERRED EMBODIMENT

With reference to the drawings, and more particularly FIG. 1, an improved metal crimping tool embodying the present invention is illustrated generally at 10 and includes a base plate 12 which may be constructed of any convenient and suitably strong material, although aluminum, because of its characteristic light weight, is preferred. The tool is power actuated and to that end there is provided a suitable power source represented by a pneumatic motor 14. A drive rod 16 protrudes through a bushed opening in one end 17 of the motor. The drive rod permits transmission of the motive power of the motor to the unit. The motor is rotatably secured in a plane parallel to the plate 12 by means of a pin 19 which permits limited rotational movement of the cylinder 14 with respect to the plate, thus minimizing any bending moments which might occur during operation of the device on the rod 16.

The working portion of the tool is best illustrated in FIGS. 2 and 6 wherein a forming unit is illustrated in detail and identified generally at 22. As illustrated, particularly in FIG. 6, the forming unit comprises a pair of adjacent opposed guides 24 and 25, respectively, which are secured in place on the plate 12 in any suitable fashion such as by screws 27. As best seen in FIG. 6, a space between the opposed faces of the guides defines a channel 26 into which portions of continguous metal sheets, of which sheets 29 and 30 are exemplars, are placed for clinching. Typically, such sheets are flanged as at 31 and 32 respectively prior to the clinching process, but that is not a necessity. In any event, the portion of the sheets to be clinched is inserted in the channel 26 so as to be positioned transverse to the axis of the forming unit.

Actual clinching is accomplished by means of a sharp punch 35 which is pointed as at 36 and is hardened so as to be capable of readily piercing any material disposed between the guides. The punch, as best seen in FIGS. 2 and 6, rides in guide member 24 and is reciprocable therein such that when it is moved forwardly it extends through the channel to pierce the flanges 31 and 32 to form tabs 37.

A die member 40 is reciprocably disposed opposite the punch in guide 25 and is axially aligned with the punch 35. The face of the die is formed with an outwardly projecting boss defining a concavity or recess adapted to assume mating engagement with the pointed nose 36 of the punch. The boss is filleted as at 44 such that when it is driven against the tabs 37 they are swaged against the surface of the flange 32 thereby effecting a firm and reliable clinching of the metal surfaces.

The invention in its principal aspect, provides a new and improved integrated sequential timing and drive mechanism (hereinafter drive mechanism) interconnecting the power drive represented by the pneumatic motor 14 and the forming unit 22. The drive mechanism is uniquely constructed to provide the necessary sequence of punching and swaging motions required of the device with each complete cycle of the motor. In addition, means is provided for adjustment of travel of the die to accommodate variations in the thickness of the flanges and the degree of swaging desired. Thus, in accordance with the invention, the drive mechanism includes a driver bar 50 which is pivotally mounted to and adjacent the plane of the base plate 12 by means of pin 52. Pin 52 is positioned so as to make optimum use of the stroke of the drive rod to generate the necessary power at the punch, which is connected to the driver bar 50 at its forward end 54 by any suitable fastening arrangement such as that illustrated at 56 at the upper end of the driver bar as viewed in the drawings. The lower end of the driver bar is connected to the driver rod by any suitable known device such as a Himes joint so as to permit necessary reciprocal movement without stressing either the driver bar or the driver rod.

As described, upon extension of the drive rod 16 in the direction indicated by arrow A, the punch 35 will be thrust through the guide 24 and into the channel with sufficient stroke and power to pierce and form tabs on the flanges of the metal sheets disposed in the channel between the guides 24 and 25.

In order to effectuate the movement and timing of the die member 40, a slave arm 63 is provided and, as in the case of the driver bar 50, is pivotally mounted by means of pivot pin 65 to the base plate 12. Suitable fastening means for securing the die 40 is provided at the upper end 67 of the slave bar as seen in FIG. 1. It is desired that at the beginning of each cycle the tool assume a normal open position, i.e., the punch and die withdrawn into the guide so as to free the channel between the guides 24 and 25 for receipt of metal sheets to be joined. To this end, biasing means such as a spring 70 is secured between the lower end 72 of the slave bar towards a clockwise rotation about the pivot pin 65, thereby urging said die in a direction away from said punch and the area of the channel.

In order to coordinate the timing and relative movement between the punch and die to effect the proper sequence of operations, a collapsible link indicated generally at 75 is provided and in the illustrated case, comprises a pair of elongated rigid coplaner sections 77 and 78 interconnected at their adjacent termini for relative rotation about a pivot pin 80. The sections are likewise attached for limited pivotal movement to the driver bar and slave bar respectively with the section 77 being attached to the driver bar by pin 82 and section 78 being attached to the slave bar by pin 84. The collapsible link as the connection between the driver bar and slave bar is adapted to assume a rigid posture during the course of the outward stroke of the drive bar and to retain that posture until the sheet metal members disposed in the channel of the forming unit are punched and swaged and to thereafter be automatically collapsed to cause the tool to again cycle to its starting position.

It may now readily be seen that the reciprocal motion of the drive rod 16 imparts a sequential movement of the punch and die to effect the clinching of sheets of metal interposed in the channel between the guides 24 and 25. More particularly, and with reference to FIG. 4, the relative position of the elements are shown as they would appear at the commencement of a work cycle with the tool normally in open position for receipt of metal sheets. As illustrated, the collapsible link 75 has been collapsed about pin 80, and is at rest against a stop 86. A spring 87 is provided and the link 75 when collapsed acts against the bias of the spring 87 which extends between a mounting point 89 on the section 77 in proximity to the adjacent termini thereof with the other end being mounted on the driver bar 50 in proximity to the connector assembly 60 between the driver bar and the drive rod. It will also be observed that the punch and die members are withdrawn from the area of the channel. As a cycle is commenced, the drive rod 16 proceeds outwardly in the direction of the arrow A and the driver bar 50 is rotated about its pivot 52 to urge the punch toward the channel. Coincident with that motion, the bias of the spring 87 urges the collapsed sections 77 and 78 downward, as viewed in FIG. 4, causing them to rotate relative to one another about the pin 80, toward a rigid locked configuration. It will also be observed that as the section 77 and 78 proceed towards a position in which they are in axial alignment as seen in FIG. 5, such movement results in a couterclockwise rotation of the slave bar 63 about its pivotal mount 65 and against the bias of spring 70 thereby urging the die towards the space between the guides and the advancing punch, but that motion is initiated with a slight sequential delay. The linkage described is proportioned to provide a slight time delay and speed variation, and accordingly, the punch will continue to advance more rapidly towards the sheet metal members inserted in the space between the guides than will the die. Thus, in keeping with this aspect of the invention, as the drive rod reaches the limit of its stroke in the direction A, the punch will have pierced the metal members disposed in the channel 26 and caused tabs 37 to be formed, as indicated in FIG. 2.

It will be observed, particularly in FIG. 5, that the relationship between the section 77 and 78 is such that once they have become coaxial, their adjacent terminal ends will abutt and will become essentially rigid under the influence of the bias of spring 87 thereby forming a rigid link between the driver bar and slave bar. As the drive rod begins its return stoke, therefore, the driver bar will be caused to rotate counterclockwise about its pivot pin 52 which, because of the rigidity of collapsible link 75 in this mode, results in a proportionate counterclockwise movement of the slave bar 63 and thus the die 40 ultimately to assume a position as seen more particularly in FIG. 2 where the die causes swaging of the tabs raised by the punch and thus effects the clinching of the metal parts.

It is still another attribute of the present invention that adjustable release is provided which results in the mechanism assuming its normally open position once the die has proceeded by the desired distance against the tabs formed in the metal flanges. Accordingly, a cam member 90 is adjustably positioned by means of any suitable fastening device 92 on the base plate in a position to intersect the path of the adjustable link as the drive rod is retracted. A cam surface 94 is selectively positioned by means of loosening the fastener 92 so as to be disposed in the path of a breaker cam follower 97 formed on the section 78. It will be seen, therefore, that as the drive rod 16 continues its retraction stroke in a direction B the ramp 97 engages and rides up on the cam surface 94 causing section 78 to be rotated clockwise about its mounting pin 84 with the result that the collapsible link 75 is broken or collapsed about the pivot pin 80 automatically and the tool thus quickly releases the clinched metal members and again assumes a normally open posture as illustrated in FIG. 4. It is then ready to receive new metal flanges and proceed with the next operation. It will be understood that by proper adjustment of the cam member 90, the precise position at which the collapsible link will be broken can be determined. That adjustment will likewise determine the axial movement of the die and thus its total travel against the metal members disposed in the channel 26. Accordingly, various thicknesses of metal may be accommodated with the precise amount of swaging effect being delivered to the metal irrespective of the thickness involved.

By reference to FIG. 3, which illustrates the handling side of the base plate 12, it will be seen that a pair of hand grips 99 are conveniently provided to permit ready handling of the device. A control valve 100 of known construction is connected by pneumatic lines 102 to the motor 14 thereby permitting the operator simply to press the button 104 to supply air pressure from any suitable source to the motor to effect a complete cycle of the device as previously described. It will further by understood that the position of the guides and the punches can be adjusted without departure from the invention to accommodate various working positions thereby premitting the machine to work horizontally or vertically depending upon the specific task to be performed.

The invention claimed is:

1. A hand held powered metal clinching device including a hand holdable base plate, a forming unit comprising axially aligned opposed punch and die members adapted to sequentially pierce, tab and swage contiguous sheets of metal disposed in a channel defined in said forming unit between said punch and said die, and a reciprocable power source for actuating and driving said punch and die members, the improvement comprising:

an integrated sequential timing and drive mechanism disposed between and interconnecting said forming unit and said power source so as to transmit power and movement from said power source to said forming unit to move said punch and said die in a predetermined sequence of integrated operations, said mechanism including, a driver bar rotatably mounted to said plate and adapted to interconnect said punch and said power source, a slave bar pivotally mounted to said plate in spaced relation to said drive arm and having an end thereof connected to said die, means biasing said slave arm to urge said die in a direction away from said punch, and means interconnecting said driver bar and slave bar for transmission of timed power and motion therebetween, comprising a collapsible link, said link adapted to assume a rigid posture during the piercing, tabing and swaging motion of said forming unit, and adapted to collapse upon completion of swaging to cycle the forming unit to its starting position.

2. The apparatus disclosed and claimed in claim 1 wherein camming means is provided to collapse said collapsible link, said camming means being disposed in the path of movement imparted to said collapsible link during swaging motion so as to engage the same at a predetermined position.

3. The apparatus disclosed and claimed in claim 2 wherein the position of the camming means is adjustable to thereby adjust the length of the swaging motion of said apparatus.

4. The apparatus disclosed and claimed in claim 1 wherein said collapsible link comprises coplaner rigid elongated sections, said sections having adjacent termini, means interconnecting said adjacent termini so as to permit limited relative rotational movement between a rigid position and a collapsed position.

5. The apparatus disclosed and claimed in claim 4 wherein bias means is provided, said bias means being disposed between said driver bar and one of said sections, said bias means adapted to urge said sections toward a rigid position.

6. The apparatus disclosed and claimed in claim 4 wherein bias means is provided, said bias means being disposed between said driver and attached to one of said sections adjacent to and connected with said driver bar.

7. The apparatus disclosed and claimed in claim 5 wherein adjustable camming means is provided to collapse said collapsible link, said camming means being disposed in the path of movement imparted to said collapsible link during swaging motion so as to engage the same at a predetermined position and means defining a cam follower is formed on one of said sections and adapted to engage said cam.

* * * * *